United States Patent [19]

Fisher et al.

[11] Patent Number: 4,480,578

[45] Date of Patent: Nov. 6, 1984

[54] BRACKET FOR ATTACHING DEMOUNTABLE PARTS TO VEHICLES AND THE LIKE

[76] Inventors: Franklin D. Fisher, 113 Maple Ct., Buchanan, Mich. 49107; Kenneth W. Clark, 6889 Curtis Dr., Coloma, Mich. 49038

[21] Appl. No.: 419,088

[22] Filed: Sep. 16, 1982

[51] Int. Cl.[3] ..... B63B 21/64

[52] U.S. Cl. ..... 114/344

[58] Field of Search ..... 114/344, 230, 221 R; 403/353, 354, 363; 5/201

[56] References Cited

U.S. PATENT DOCUMENTS

| | | | |
|---|---|---|---|
| 2,227,725 | 1/1941 | Laddon | 114/344 |
| 2,421,671 | 6/1947 | West | 114/344 |
| 2,484,346 | 9/1947 | Iorns . | |
| 2,522,616 | 2/1946 | Husek . | |
| 2,624,591 | 12/1949 | Choplin . | |
| 2,630,303 | 3/1953 | Krucker | 403/353 |
| 3,047,061 | 7/1962 | Wilcox et al. | 403/353 |
| 3,177,839 | 4/1965 | Nolf | 114/230 |
| 3,220,745 | 10/1963 | DeCharme . | |
| 3,537,117 | 2/1969 | Plesnevich . | |
| 3,659,868 | 2/1972 | Tucker . | |
| 3,697,096 | 10/1972 | Hadley . | |
| 4,225,265 | 9/1980 | Hooker et al. | 403/353 |
| 4,413,366 | 11/1983 | Whitehead | 5/201 |

FOREIGN PATENT DOCUMENTS

| | | | |
|---|---|---|---|
| 2442765 | 8/1980 | France | 114/344 |
| 529103 | 2/1977 | U.S.S.R. | 114/344 |

*Primary Examiner*—Trygve M. Blix
*Assistant Examiner*—Thomas J. Brahan
*Attorney, Agent, or Firm*—Marmaduke A. Hobbs

[57] ABSTRACT

A wheel and mounting bracket assembly for boats and the like in which the wheel support has a vertically positioned shaft-like strut with a pair of spaced pins extending laterally therefrom, and a bracket having a body with side walls forming a generally U-shaped, elongated channel for receiving the strut in parallel relation therewith. Two pairs of opposed slots are disposed in the side walls in the outer edge for receiving the pins of the strut, and a latch having a longitudinal bolt locks the pins in one of the slots. The upper slot is preferably of an L-shaped configuration and the lower slot is of a straight inwardly extending configuration, and the lock is preferably used in conjunction with the straight slot to lock the pin therein. The bracket has uses other than mounting wheel assemblies and the like, such additional uses including securing a tow bar and anchor cable to the boat.

9 Claims, 11 Drawing Figures

BRACKET FOR ATTACHING DEMOUNTABLE PARTS TO VEHICLES AND THE LIKE

BACKGROUND OF THE INVENTION

The conventional practice of transporting small boats such as outboard motor boats, is to load the boat on a trailer and tow the trailer with an automobile or truck, and when the boat is to be unloaded from the trailer, the trailer and the boat are backed into the water to the point where the boat can float away from the trailer. The trailer is then normally removed from the water. When the boat is to be removed from the water, it is loaded on the trailer by backing the trailer into the water and floating the boat onto the trailer, and after it is secured to the trailer, the trailer is towed by the vehicle from the water. Boat trailers are not only relatively heavy, bulky and expensive, but they require a substantial amount of space to store when they are not in use and are attractive objects for thieves while the boat is in the water and being used by the owner. Attempts have been made and devices have been built for attaching wheels to a boat so that the boat forms, in effect, part of a trailer capable of being towed by an automobile or truck; but these prior devices have had certain features that rendered them unsatisfactory or impractical, including difficulty of mounting the wheels on and removing them from the boat, or they are relatively complicated in construction and operation and are not easily and safely stored when the boat is being used. Further, these prior devices and parts thereof have generally been limited in use to the transporting of boats and could not be utilized or adapted for other purposes.

SUMMARY OF THE INVENTION

One of the principal objects of the present invention is to provide a bracket for attaching demountable parts to boats and the like, which reliably retains a wheel assembly firmly on a boat for towing the boat on the highway and releases the wheel assembly when the boat is placed in the water, and which is so constructed and designed that the bracket can be permanently mounted on the boat or the like without adding undue weight or bulk to the boat.

Another object of the present invention is to provide a bracket and removable wheel assembly for boats and the like, which permits the wheel assembly to be easily removed from and attached to the boat while the boat is in the water, and which can be easily and safely stored, either in the boat, tongue assembly or in the trunk of a car or in a station wagon while the boat is in use.

Still another object of the invention is to provide a bracket for performing the foregoing function, which is relatively compact and easily manipulated to attach and hold the demountable parts, and which can be used for a variety of different uses other than securing the wheel assembly, including securing the tow bar or tongue to the boat, securing the chain or cable of an anchor, or holding a winch for ropes and cables or down riggers.

A further object is to provide a bracket and wheel assembly for boats and the like, which permits the wheel assembly to be mounted on or removed from the boat by one person inside the boat, with the water assisting in the assembling and disassembling operations, and which permits the boat to be maneuvered into limited access areas unusable by the conventional boat trailers.

The foregoing objects and advantages of the present invention are accomplished by a bracket adapted to be secured to the transom of a boat or other suitable place for receiving the wheel assembly shaft or strut, using a vertical angular movement about a pivot pin or point, preferably in the upper part of the bracket. The body of the bracket is generally U-shaped in configuration and has a base secured to the body for attaching the bracket to the boat or other vehicle. The open portion of the U-shaped body faces rearwardly when the bracket is used to hold a wheel assembly, so that the shaft or strut extending upwardly from the wheel can pivot angularly into and from the open portion as the wheel assembly is attached to and removed from the bracket. This permits the water to assist in the mounting and demounting operations, in that forward movement of the boat causes or assists in dislodging the wheel shaft or strut from the U-shaped body of the bracket, and rearward movement of the boat assists in seating the shaft or strut in the body. When the shaft or strut has been seated in the body, it is locked firmly and safely in place by a latch pin easily manipulated by someone inside the boat.

BRIEF DECRIPTION OF THE DRAWINGS

DESCRIPTION OF THE PREFERRED EMBODIMENT

Figure 1:
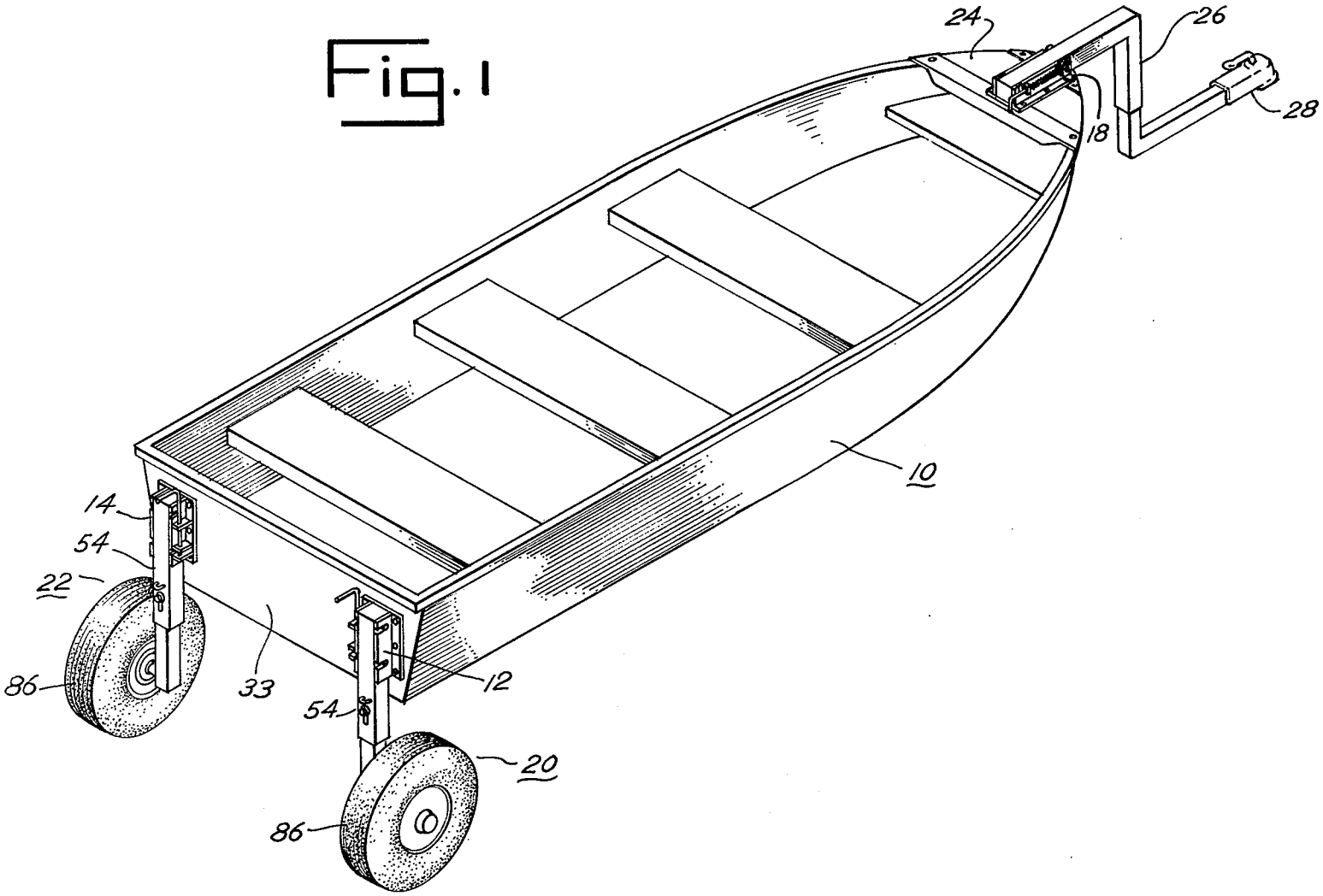
FIG. 1 is a perspective view of a boat with the present bracket and wheel assemblies mounted on the transom and with the present bracket and the tow bar mounted on the bow.
Figure 2:
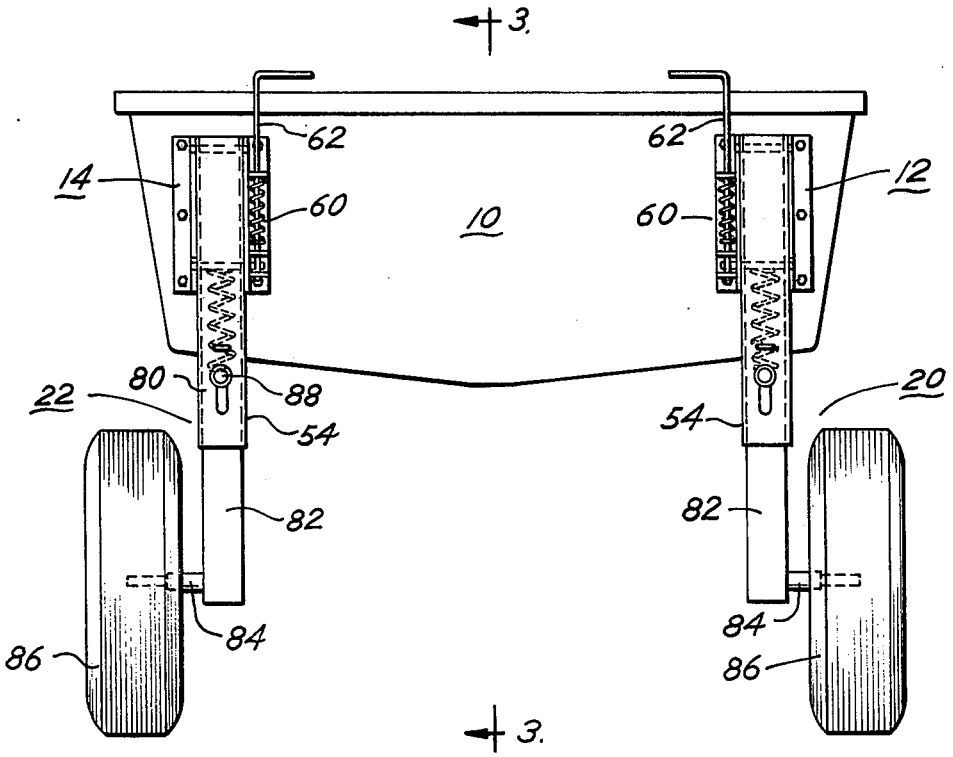
FIG. 2 is a rear elevational view of the boat and bracket and wheel assemblies shown in FIG. 1.
Figure 3:
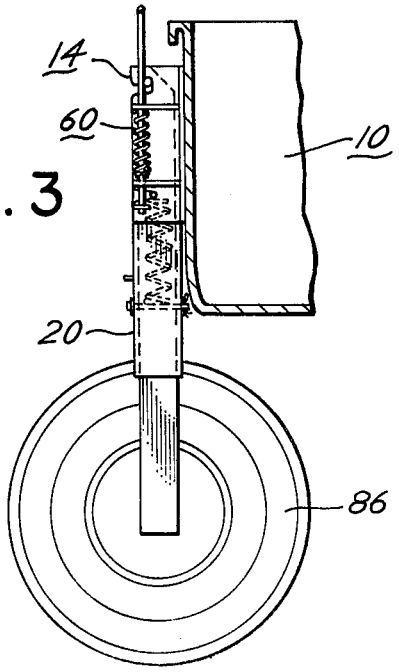
FIG. 3 is a vertical cross sectional view of the boat and an elevational view of the bracket and wheel assembly taken on line 3—3 of FIG. 2.

Referring more specifically to the drawings and to FIG. 1 in particular, numeral 10 indicates generally an outboard motor boat of conventional construction with the present brackets 12, 14 and 18 secured thereto, and with brackets 12 and 14 securing wheel assemblies 20 and 22 to the boat. Bracket 18 is secured to member 24 on the bow of the boat and secures a tow bar 26 to the boat. The tow bar is shown with a socket member 28 for securing the tow bar to a hitch mounted on a towing vehicle, such as an automobile or pickup truck. The present bracket and wheel assembly can be adapted to a number of different types and designs of boats, and the bracket can be used for a variety of different purposes, including securing the wheel assemblies, tow bar, anchor, winch and motor to the boat, and can be used as a general purpose securing bracket.

Figure 4:
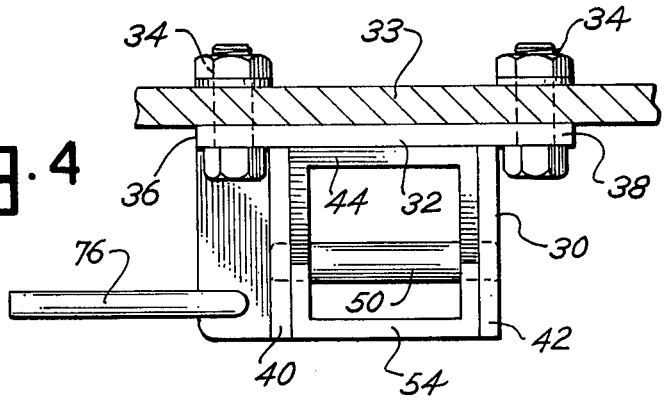
FIG. 4 is a top plan view of the present bracket, showing it secured to the transom of the boat.

The present bracket shown in FIG. 1, regardless of its use, is essentially the same, and hence, only one will be described in detail herein. The bracket, the details of which are best seen in FIG. 4, consists of a U-shaped body 30 secured to a base plate 32, which in turn is secured to the transom 33, for example, of a boat, by a plurality of bolts 34 extending through holes in flanges 36 and 38 of base plate 32. When the bolts have been tightened in place, the body is secured rigidly to the boat and will remain permanently thereon until intentionally removed. The two sides 40 and 42 and bottom 44 form the U-shaped body having an open top, bottom and rear side as viewed in FIGS. 4, 5 and 6. The two sides 40 and 42 have opposing upper L-shaped slots 46 and opposing lower straight slots 48 for receiving upper and lower pins 50 and 52, respectively, of the shaft or strut 54 of the wheel assembly. The U-shaped body forms a generally rectangular space between the two sides 40 and 42, and the normally square tubular strut 54 of the wheel assembly, and the two pins which are secured in the strut project laterally from the strut sufficiently to form studs which seat in slots 46 and 48 of the two sides 40 and 42 and project laterally beyond one side sufficiently to permit the latch, indicated generally by numeral 60, to lock the strut in the bracket. While the upper slots 46 are shown as L-shaped, they will function satisfactorily if the slots are straight and disposed at an angle different from slots 48, the latter of which normally extend inwardly from the edges of the side walls at substantially right angles thereto.

Figure 5:
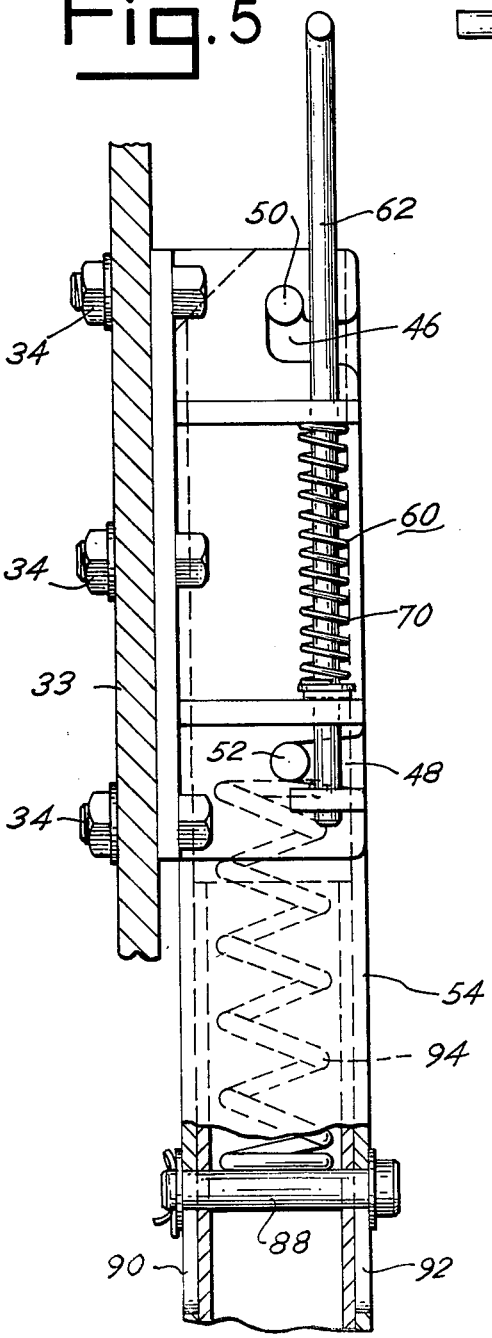
FIG. 5 is a side elevational view of the present bracket and a fragmentary partial cross sectional view of the shaft or strut of the wheel assembly.
Figure 6:
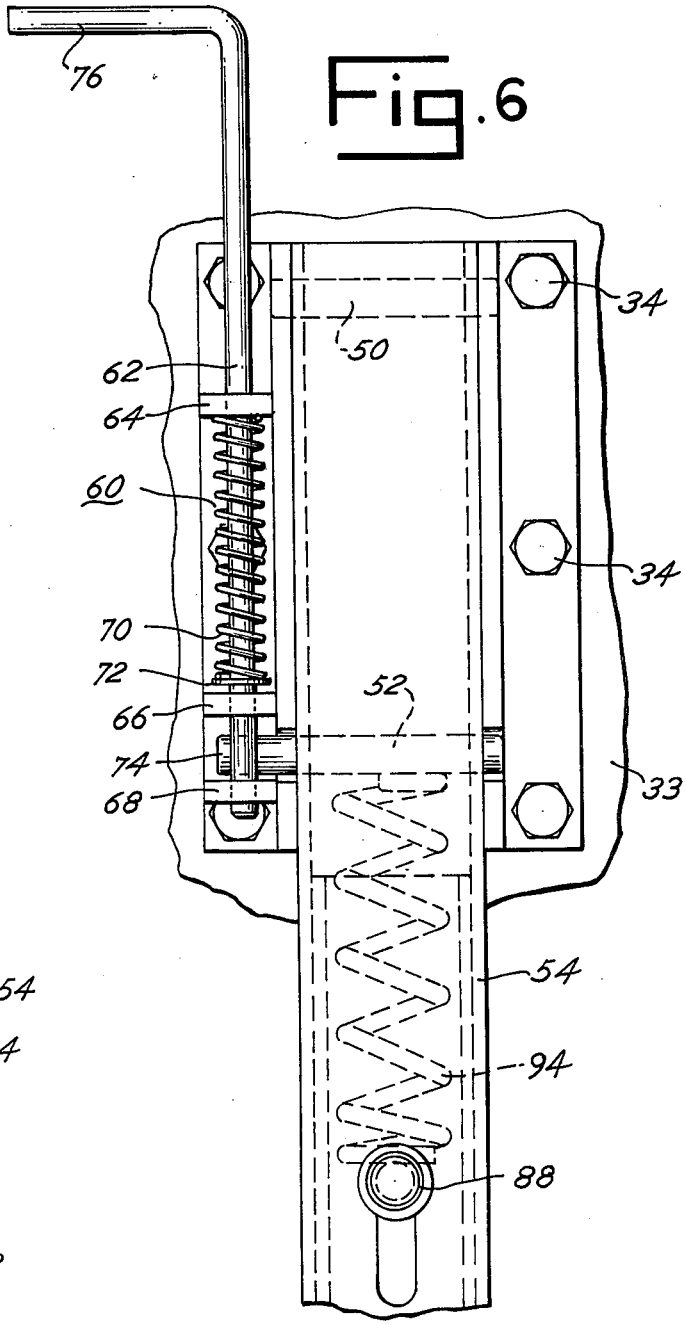
FIG. 6 is a rear elevational view of the present bracket and a fragmentary view of the shaft or strut of the wheel assembly.
Figure 7:
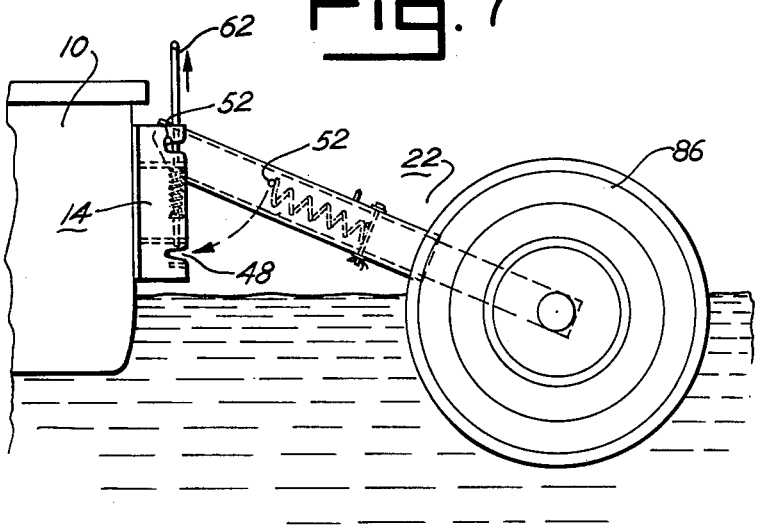
FIGS. 7 and 8 illustrate the manner in which the present bracket and wheel assembly are mounted on and demounted from the boat.
Figure 8:
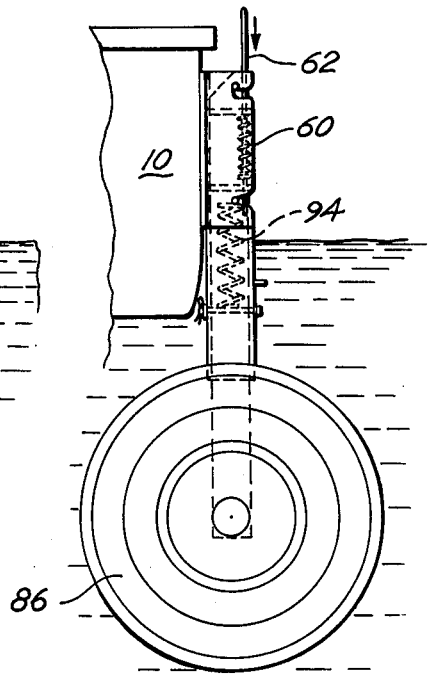
Figure 9:
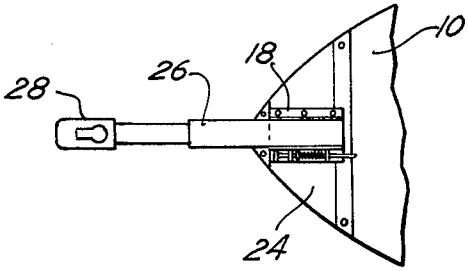
FIGS. 9, 10 and 11 are top plan, side and elevational views of the bracket and a tow bar used in connecting the boat shown in FIG. 1 to a vehicle such as an automobile or pickup truck.
Figure 11:
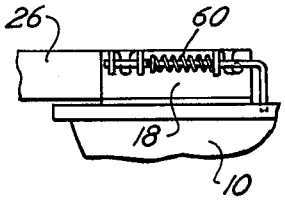
Figure 10:
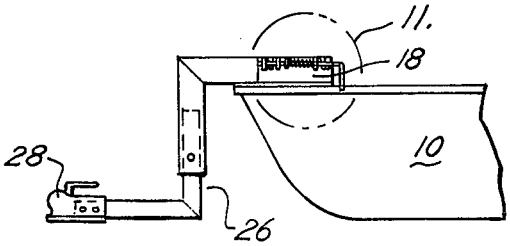

The latch consists of a longitudinally moveable bolt 62 extending through holes in members 64, 66 and 68 secured to side 40 and to flange 36 of base plate 32, in the embodiment illustrated in FIGS. 4, 5 and 6. A spring 70 reacting between the underside of member 64 and a fixed collar 72 on rod 62 constantly urges the rod to its latched position, which holds pin 52 in its seated position in slot 48 and secures the strut in body 30 of the bracket. To insert the end 74 of pin 52 in the slot, the rod, which is provided with an overturned end 76 for use as a handle, is lifted against the force of the spring sufficiently to permit end 74 of pin 52 to pass beneath the lower end of the rod and seat in slot 48, after pin 50 has been inserted in slot 46, as will be more fully explained hereinafter. As shown in the drawings, right and left bracket models are used, in which the latch 60 in each model is on the inner side of the bracket, thus requiring slightly different brackets, depending upon the side on which the bracket is to be used. However, the same bracket, for example the right hand model, can be used satisfactorily for both the right and left sides, provided pin 52 is extended laterally to the left, as seen in FIG. 6, so that extension 74 of the pin will be locked in place.

The wheel assembly shown in the drawings, except for the shape of the strut, is primarily for illustrative purposes only, the assembly shown consisting of strut 54 having an upper section 80 and a lower section 82 telescopically mounted in the lower end of section 80 and having an axle 84 and wheel 86 on the lower end thereof. The two struts, 20 and 22, are essentially identical in construction and operation, the difference in the drawing between the two merely being in the reversal of the wheel from the right side to the left side of the strut by rotating the strut one-half turn. This also reverses the position of extension 74 of pin 52. The two sections of the strut are held together by a pin 88 carried by lower section 82 and extending into opposing slots 90 and 92 of upper section 80, thus permitting the two sections to move longitudinally a predetermined distance with respect to one another. A spring 94 reacts between pin 88 and pin 52, urging pin 88 and the lower section 82 downwardly and forming an effective shock absorbing mechanism for the wheel assembly, the pin being shown at the lower end of the slot in that the weight of the boat is insufficient to compress the spring; however, the effectiveness of the shock absorber can be varied by changing the strength of spring 94. The wheel assembly is preferably connected to the boat by a chain or cable (not shown), so that when it is removed from or assembled in the bracket while the boat is in the water, it will not be lost in the event it is accidentally dropped while the mounting or demounting operations are being performed.

In the operation and use of the present bracket and wheel assembly, the brackets are secured to the transom of the boat in the manner illustrated in the drawings and described herein, by bolts 34 extending through plate 32 and the boat transom. While the boat is out of the water, the wheel assemblies are normally mounted on the boat for transporting the boat to a navigable body of water by inserting pins 50 in L-shaped slots 46 of sides 40 and 42 and with rod 62 held in its lifted position, pivoting strut 54 inwardly into the U-shaped body until pins 52 seat in the two straight slots at the bottom. When the rod is released, spring 70 urges it downwardly, thereby locking extension 74 of pin 52 in the bottom slot 48. After the two wheel assemblies have been mounted on the boat and locked in place in the foregoing manner, the towbar 26 can be secured to the boat by bracket 18 in a manner similar to that just described with reference to the brackets 12 and 14. With the wheel assemblies and tow bar mounted on the boat, the tow bar is connected to an automobile, pickup truck or other towing vehicle and the boat is towed as a normal trailer on the highway behind the vehicle to the body of water. The boat with the wheels is normally backed into the water and the tow bar is removed from the boat. The boat would normally be turned away from the shore and, with the boat moving at a slow pace forwardly, bar 62 of the latch 60 is lifted, thereby releasing pin 52 and permitting the strut to pivot rearwardly, facilitated by the inflated tire which tends to rise to the suface of the water. This disengages the strut from the U-shaped body with the exception of the pin 50, which is then removed from L-shaped slot 46 by pressing the strut downwardly to permit the pin to slide from the vertical portion of the slot to the horizontal portion, where it is then removed from the slot, which movement is facilitated by the forward movement of the boat away from the wheel assembly. When pins 50 have been disengaged from slots 46 in the two sides 40 and 42, the wheel assembly can then be lifted into the boat and, in view of its relatively small size, it can remain therein until the boat is to be removed from the water.

When the boat is to be removed from the water, the wheel assemblies 20 and 22 are again reassembled on the two brackets 12 and 14 by inserting pins 50 of the two wheel assemblies in slots 46 while the strut extends rearwardly with the wheel partially floating on the water. After pins 50 are seated in the vertical portion of L-shaped slots 46, the wheel assembly is pushed downward into the water and the buoyancy of the wheel causes the pins 50 and 52 to fit snugly into slots 46 and 48. As the struts approach the fully downward position, the rods 62 of the latches on the two brackets are lifted to permit the end 74 of pin 52 to pass beneath the pin, thereby permitting the pins to seat fully in the slots 48;

the rod is then released, permitting the spring to press the rod downwardly to the position shown in FIGS. 5 and 6 to latch the struts in the respective brackets. The tow bar can then be secured to bracket 18 and the boat towed from the water in the final assembled position for towing on the highway.

It is seen from the foregoing description that the present brackets permit the wheels to be demounted from and mounted on the boat while the boat is in the water, without the operator entering the water, and the mounting and demounting operations can be performed with little or no risk to any of the occupants of the boat, including the one mounting and demounting the wheel assemblies. The use of the bracket to secure the tow bar to the bow of the boat illustrates another one of a number of uses for the bracket mentioned hereinbefore.

While only one embodiment of the present bracket for attaching demountable parts to vehicles and the like has been shown and described in detail herein, various other changes and modifications may be made without departing from the scope of the invention.

We claim:

1. A wheel and mounting bracket assembly for boats and the like, comprising a wheel support having a vertically positioned shaft-like strut with a pair of spaced pins extending laterally therefrom, a bracket having a body with upper and lower ends and with side walls having vertical outer edges and forming a generally U-shaped elongated channel for receiving said strut in parallel relationship therewith, spaced pairs of upper and lower opposed slots in said side walls in the outer edge thereof for receiving said pins on said strut, said upper pair of opposed slots of said side walls being of an L-shaped configuration and being disposed near the upper end of said body and intersecting the outer edges of said vertical walls and said lower pair of opposed slots being of a straight configuration extending horizontally inwardly from said outer edges and disposed downwardly from said upper pair of opposed slots, a latch means having a longitudinally moveable bolt for locking the pin received in said straight slot in seated position therein, and a means for securing said body to a supporting member.

2. A wheel and mounting bracket assembly for boats and the like as defined in claim 1 in which the pin seating in the straight slots extends laterally outwardly from said side walls, and said latch means has a spring for urging said bolt to its locked position relative to said pin.

3. A wheel and mounting bracket assembly for boats and the like as defined in claim 2 in which said side walls are positioned vertically in spaced relation to one another, and said L-shaped slots include a first portion extending inwardly from the outer edge of each of said walls and a second portion extending upwardly from the end of said first portion.

4. A wheel and mounting bracket assembly for boats and the like as defined in claim 1 in which said side walls are positioned vertically in spaced relation to one another, and said L-shaped slots include a first portion extending inwardly from the outer edge of each of said walls and a second portion extending upwardly from the inner end of said first portion.

5. A wheel attachment assembly for boats having a transom, comprising a normally vertical shaft-like member having upper and lower spaced transversely positioned pins, and a bracket having a body with vertically positioned side walls for interlocking in longitudinal position with said shaft-like member and having means for mounting said bracket on the boat transom, said walls having upper and lower spaced pairs of opposed slots in the outer rear edge thereof for receiving said spaced pins on the shaft-like member, the upper pair of said opposed slots extending inwardly from the edges of the side walls and upwardly therefrom to a closed end and the lower of said pair of opposed slots extending generally horizontally inwardly from said rear edge, and a latch for locking said lower pins in said lower slots to hold said shaft-like member in interlocked position with said bracket.

6. A wheel attachment assembly as defined in claim 5 in which said side walls are positioned vertically in spaced relation to one another and said upper opposed slots are disposed in the upper portion of said walls and include a first portion extending inwardly from the edge of each of said walls at substantially right angles thereto and a second portion extending at a right angle from the inner end of said first portion.

7. A combination as defined in claim 5 in which said side walls are positioned vertically in spaced relation to one another and said upper opposed slots are of a generally L-shaped configuration including a first portion extending inwardly from the rear edge of each of said walls and a second portion extending upwardly form the end of said first portion.

8. A wheel and mounting bracket assembly for boats and the like, comprising a wheel support having a vertically positioned shaft-like strut with upper and lower pairs of spaced pins extending laterally therefrom, a bracket having a body with upper and lower ends and with side walls having vertical outer edges and forming a generally U-shaped elongated channel for receiving said strut in parallel relationship therewith, spaced pairs of upper and lower opposed slots in said side walls in the outer edge thereof for receiving said pins on said strut, said upper pair of opposed slots of said side walls having a portion with an upper closed end and in a generally vertical position and being disposed near the upper end of said body and intersecting the outer edges of said vertical walls, and said lower pair of opposed slots being of a straight configuration extending horizontally inwardly from said outer edge and disposed downwardly from said upper pair of opposed slots, said pairs of spaced pins being spaced from one another such that the lower pair of pins seat in said lower horizontal slots when said upper pair of pins are seated on said upper closed ends of said upper pair of slots, and a latch means for locking the lower pair of pins in said lower pair of slots.

9. A wheel and mounting bracket assembly defined in claim 8 in which said side walls are in spaced relation to one another, and said upper slots are L-shaped with a first portion extending inwardly from the edge of each of said walls and a second portion extending at a right angle from the inner end of said first portion.

* * * * *